US011250805B2

(12) United States Patent
Kim et al.

(10) Patent No.: US 11,250,805 B2
(45) Date of Patent: Feb. 15, 2022

(54) DISPLAY APPARATUS

(71) Applicant: LG Display Co., Ltd., Seoul (KR)

(72) Inventors: MinKi Kim, Paju-si (KR); JinSung Kim, Paju-si (KR); HyunTaek Nam, Paju-si (KR); Gyeonghwan Kim, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/116,486

(22) Filed: Dec. 9, 2020

(65) Prior Publication Data

US 2021/0193074 A1 Jun. 24, 2021

(30) Foreign Application Priority Data

Dec. 24, 2019 (KR) ..... 10-2019-0173673

(51) Int. Cl.
*G09G 3/36* (2006.01)
*G09G 3/32* (2016.01)

(52) U.S. Cl.
CPC ..... *G09G 3/3688* (2013.01); *G09G 3/32* (2013.01); *G09G 2310/0262* (2013.01); *G09G 2310/0291* (2013.01); *G09G 2310/08* (2013.01)

(58) Field of Classification Search
None
See application file for complete search history.

(56) References Cited

U.S. PATENT DOCUMENTS

2003/0090451 A1* 5/2003 Ahn ..... G09G 3/3688 345/96
2004/0104872 A1* 6/2004 Kang ..... G09G 3/3688 345/87
2005/0285842 A1* 12/2005 Kang ..... G09G 3/3614 345/103
2011/0242088 A1* 10/2011 Kim ..... G09G 3/3685 345/214
2015/0379939 A1* 12/2015 Takasugi ..... G09G 5/18 345/690
2017/0011703 A1* 1/2017 Higuchi ..... G09G 3/3674
2017/0116948 A1 4/2017 Wen et al.
2018/0061291 A1* 3/2018 Ren ..... H01L 29/78648
2019/0051264 A1 2/2019 Kim et al.

FOREIGN PATENT DOCUMENTS

KR 10-2005-0123487 A 12/2005
KR 10-2016-0080768 A 7/2016
KR 10-2016-0094477 A 8/2016
TW 201715505 A 5/2017
TW 201939463 A 10/2019

OTHER PUBLICATIONS

Taiwan Intellectual Property Office, Office Action, TW Patent Application No. 109141873, dated Oct. 19, 2021, six pages.

* cited by examiner

*Primary Examiner* — Chad M Dicke
(74) *Attorney, Agent, or Firm* — Fenwick & West LLP

(57) ABSTRACT

The present disclosure relates to a display apparatus for generating data voltages which are to be output to pixels included in second virtual horizontal lines, based on pieces of image data corresponding to first virtual horizontal lines.

16 Claims, 12 Drawing Sheets

DISPLAY APPARATUS

CROSS-REFERENCE TO RELATED APPLICATIONS

This application claims the benefit of Republic of Korea Patent Application No. 10-2019-0173673 filed on Dec. 24, 2019, which is hereby incorporated by reference in its entirety.

BACKGROUND

Field of Technology

The present disclosure relates to a display apparatus including a display panel in which two gate lines are connected to pixels provided along one horizontal line and first-side pixels and second-side pixels provided along both sides of one data line are alternately connected to the one data line.

Discussion of the Related Art

A double rate driving (DRD) method is being applied as a method for decreasing the number of data drivers applied to a display apparatus. In display apparatuses with the DRD method applied thereto, the number of gate lines may increase by twice but the number of data lines may decrease by ½ times. That is, in display apparatuses with the DRD method applied thereto, the number of desired data drivers may decrease by half, and moreover, the same resolution as that of a related art display apparatus may be realized.

However, in display apparatuses with the DRD method applied thereto, data voltages corresponding to one horizontal line are output to data lines twice. Therefore, pieces of image data corresponding to one horizontal line are transferred from a controller to a data driver twice.

Therefore, although pieces of image data corresponding to two continuous horizontal lines are the same, the controller should individually transfer the pieces of image data, corresponding to the two continuous horizontal lines, to the data driver.

Due to this, in a related art display apparatus with the DRD method applied thereto, consumption power is being wasted.

SUMMARY

Accordingly, the present disclosure is directed to providing a display apparatus that substantially obviates one or more problems due to limitations and disadvantages of the related art.

An aspect of the present disclosure is directed to providing a display apparatus for generating data voltages which are to be output to pixels included in a second horizontal line, based on pieces of image data corresponding to a first horizontal line.

Additional advantages and features of the disclosure will be set forth in part in the description which follows and in part will become apparent to those having ordinary skill in the art upon examination of the following or may be learned from practice of the disclosure. The objectives and other advantages of the disclosure may be realized and attained by the structure particularly pointed out in the written description and claims hereof as well as the appended drawings.

To achieve these and other advantages and in accordance with the purpose of the disclosure, as embodied and broadly described herein, there is provided a display apparatus including a display panel where two gate lines are connected to pixels provided along one virtual horizontal line and a plurality of first-side pixels and a plurality of second-side pixels provided along both sides of a data line are alternately connected to the data line, a data driving unit including at least one data driver supplying a data voltage to the data line, and a controller transferring pieces of image data to the at least one data driver, wherein the at least one data driver converts the pieces of image data into data voltages, the at least one data driver outputs the data voltages to pixels of a first virtual horizontal line and pixels of a second virtual horizontal line, and the at least one data driver generates data voltages which are to be output to the pixels of the second virtual horizontal line, based on pieces of image data corresponding to data voltages output to the pixels of the first virtual horizontal line.

It is to be understood that both the foregoing general description and the following detailed description of the present disclosure are exemplary and explanatory and are intended to provide further explanation of the disclosure as claimed.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
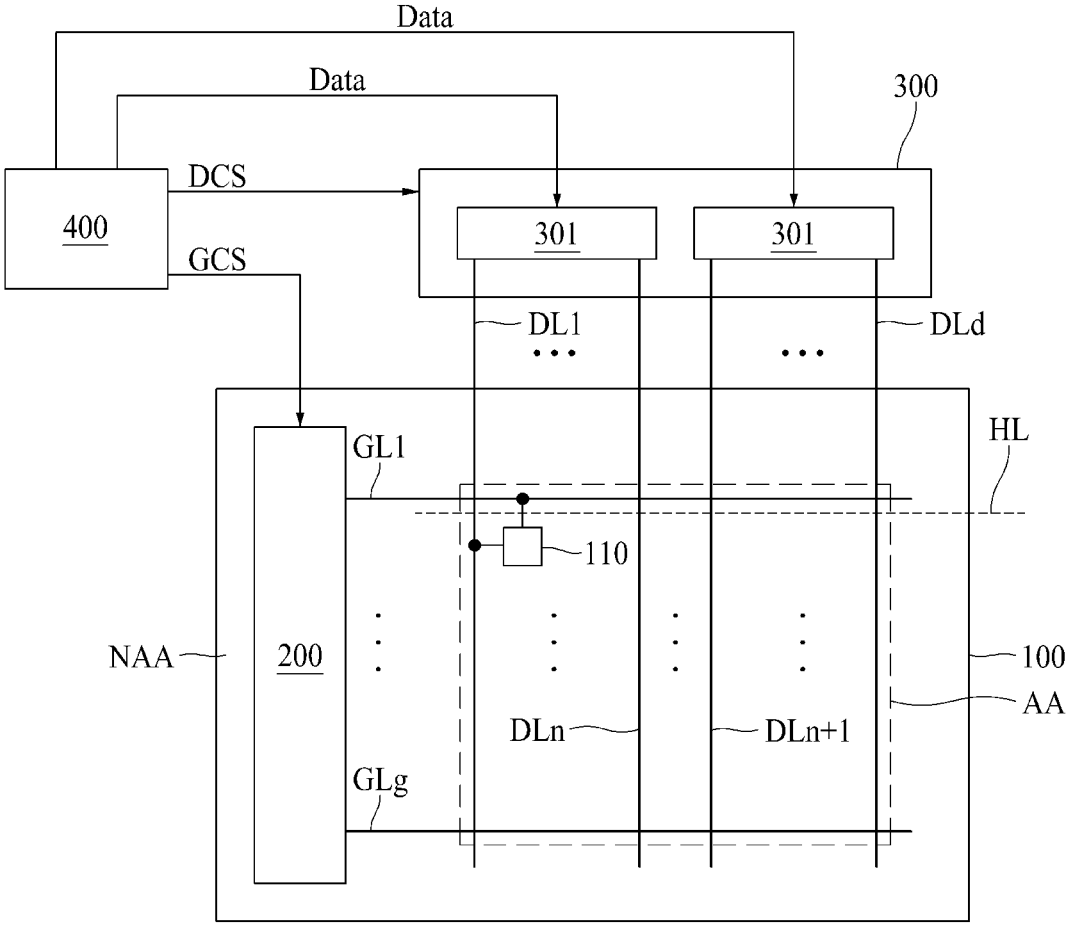
FIG. 1 is an exemplary diagram illustrating elements of a display apparatus according to one embodiment of the present disclosure.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted. In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a position relationship, for example, when a position relation between two parts is described as 'on~', 'over~', 'under~', and 'next~', one or more other parts may be disposed between the two parts unless 'just' or 'direct' is used.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

In describing the elements of the present disclosure, terms such as first, second, A, B, (a), (b), etc., may be used. Such terms are used for merely discriminating the corresponding elements from other elements and the corresponding elements are not limited in their essence, sequence, or precedence by the terms. It will be understood that when an element or layer is referred to as being "on" or "connected to" another element or layer, it can be directly on or directly connected to the other element or layer, or intervening elements or layers may be present. Also, it should be understood that when one element is disposed on or under another element, this may denote a case where the elements are disposed to directly contact each other, but may denote that the elements are disposed without directly contacting each other.

The term "at least one" should be understood as including any and all combinations of one or more of the associated listed elements. For example, the meaning of "at least one of a first element, a second element, and a third element" denotes the combination of all elements proposed from two or more of the first element, the second element, and the third element as well as the first element, the second element, or the third element.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of the present disclosure will be described in detail with reference to the accompanying drawings. In adding reference numerals to elements of each of the drawings, although the same elements are illustrated in other drawings, like reference numerals may refer to like elements. Also, for convenience of description, a scale of each of elements illustrated in the accompanying drawings differs from a real scale, and thus, is not limited to a scale illustrated in the drawings.

Hereinafter, embodiments of the present disclosure will be described in detail with reference to the accompanying drawings.

Figure 2:
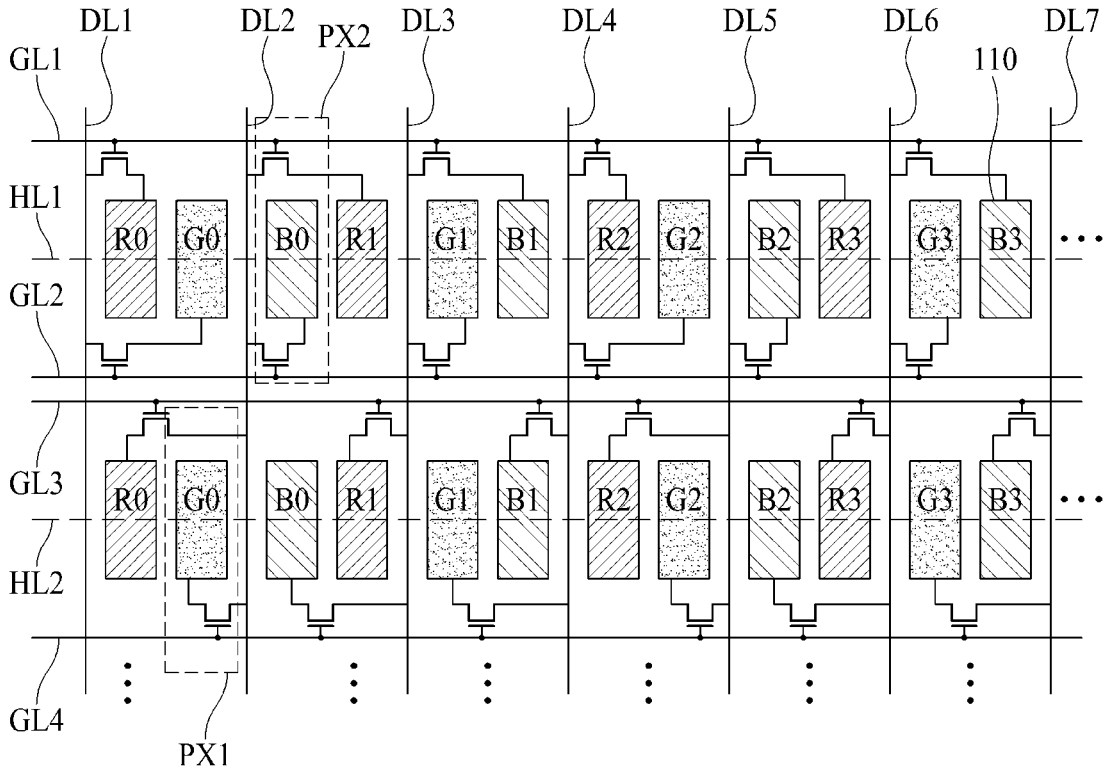
FIG. 2 is an exemplary diagram illustrating a portion of a display panel applied to a display apparatus according to one embodiment of the present disclosure.
Figure 3A:
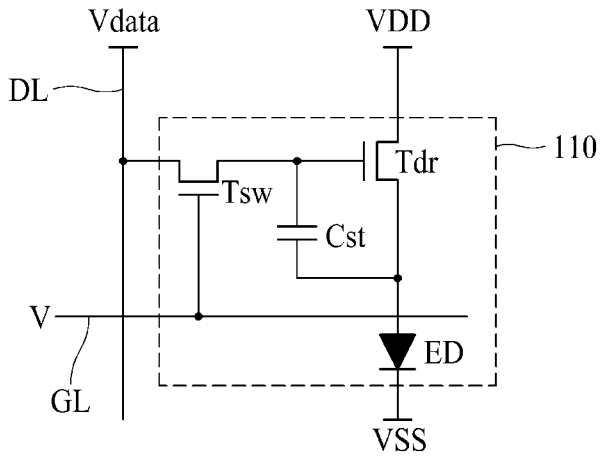
FIGS. 3A and 3B are exemplary diagrams illustrating a structure of a pixel applied to a display apparatus according to one embodiment of the present disclosure.
Figure 3B:
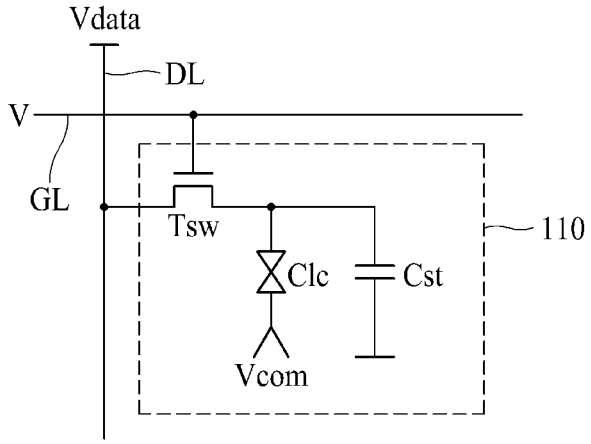
Figure 4:
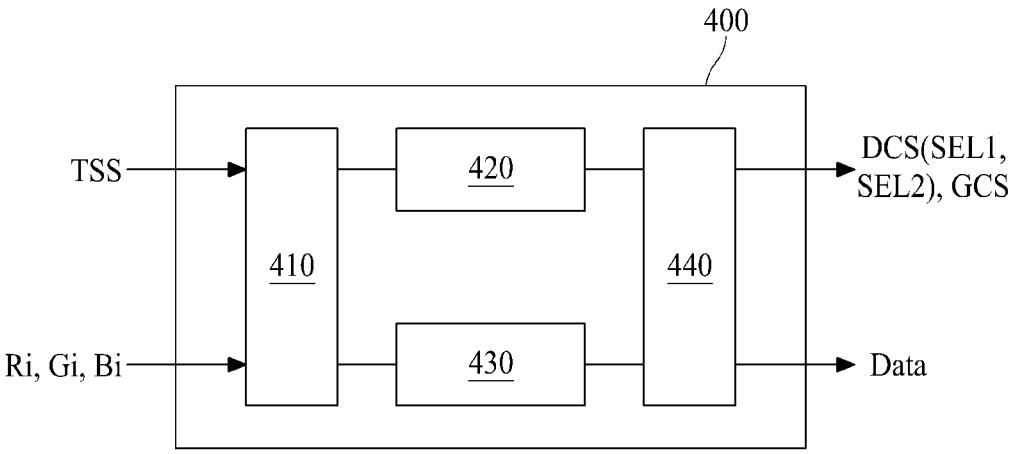
FIG. 4 is an exemplary diagram illustrating a configuration of a controller applied to a display apparatus according to one embodiment of the present disclosure.

FIG. 1 is an exemplary diagram illustrating elements of a display apparatus according to the present disclosure, FIG. 2 is an exemplary diagram illustrating a portion of a display panel applied to a display apparatus according to the present disclosure, FIGS. 3A and 3B are exemplary diagrams illustrating a structure of a pixel applied to a display apparatus according to the present disclosure, and FIG. 4 is an exemplary diagram illustrating a configuration of a controller applied to a display apparatus according to the present disclosure.

The display apparatus according to the present disclosure may be applied to various kinds of electronic devices. The electronic devices may include, for example, smartphones, tablet personal computers (PCs), monitors, etc.

The display apparatus according to the present disclosure, as illustrated in FIGS. 1 and 2, may include a display panel 100 where two gate lines GL1 and GL2 are connected to pixels provided along one horizontal line HL and first-side pixels PX1 and second-side pixels PX2 provided along both sides of one data line DL are alternately connected to the data line DL, a data driving unit 300 which includes at least one data driver 301 for supplying a data voltage to the data line DL, a gate driver 200 which supplies gate signals to a plurality of gate lines GL1 to GLg included in the display panel 100, and a controller 400 which transfers pieces of image data Data to the data driver 301.

In the following description, as illustrated in FIGS. 1 and 2, the horizontal line HL may denote a virtual line which is formed by pixels arranged in one row along a gate line GL. For example, a first gate line GL1 and a second gate line GL2 may be provided along a first horizontal line HL1 illustrated in FIG. 2, and pixels may be provided in one row between the first gate line GL1 and the second gate line GL2. The first horizontal line HL1 may denote one of horizontal lines which are formed in the display panel 100, and the second horizontal line HL2 may denote a horizontal line provided next to the first horizontal line HL1. Therefore, the first horizontal line HL1 may not denote a horizontal line disposed at an uppermost end or a lowermost end among a plurality of horizontal lines included in the display panel 100. That is, the first horizontal line HL1 and the second horizontal line HL2 may denote that an image is output through the first horizontal line HL1 and then an image is output through the second horizontal line HL2.

The display panel 100 may include a display area AA which displays an image and a non-display area NAA which surrounds the display area AA.

The gate lines GL1 to GLg may be provided in the display area AA. Particularly, as illustrated in FIG. 2, the gate lines GL1 to GLg may be connected to pixels provided along one horizontal line HL. In this case, each of the pixels may be connected to only one gate line.

A plurality of data lines DL1 to DLd may be provided in the display area AA. Particularly, the first-size pixels PX1 and the second-side pixels PX2 provided along both sides of one data line DL among the data lines DL1 to DLd may be alternately connected to the data line DL. For example, when the second-side pixel PX2 is connected to the data line in the first horizontal line HL1, the first-side pixel PX1 may be connected to the data line in the second horizontal line HL2.

A type where gate lines and data lines are connected as described above may be referred to as a double rate driving (DRD) method. In a display apparatus using the DRD method, comparing with a related art display apparatus, the number of gate lines may increase by twice, but the number of data lines may decrease by half. Therefore, comparing with the related art display apparatus, in the display apparatus according to the present disclosure using the DRD method, the number of data drivers may decrease by half.

In the display apparatus according to the present disclosure, the data driving unit 300 may include two or more data drivers 301. Hereinafter, for convenience, a display apparatus where the data driving unit 300 includes the two data drivers 301 will be described as an example of the present disclosure. Accordingly, features of the present disclosure to be described below may be applied to a display apparatus including three or more data drivers 301.

The display panel 100 may be a light emitting display panel configured with a light emitting device, or may be a liquid crystal display panel which displays an image by using a liquid crystal.

When the display panel 100 is the light emitting display panel, as illustrated in FIG. 3A, a pixel 110 included in the display panel 100 may include a light emitting device ED, a switching transistor Tsw, a capacitor Cst, and a driving transistor Tdr.

The light emitting device ED may include one of an organic light emitting layer, an inorganic light emitting layer, and a quantum dot light emitting layer, or may include a stacked or combination structure of an organic light emitting layer (or an inorganic light emitting layer) and a quantum dot light emitting layer.

When the display panel 100 is the liquid crystal display panel, as illustrated in FIG. 3B, a pixel 110 included in the display panel 100 may include a liquid crystal Clc, a switching transistor Tsw, a common electrode Vcom, and a capacitor Cst.

When the display panel 100 is the liquid crystal display panel, the display apparatus may further include a backlight which irradiates light onto the liquid crystal display panel.

The controller 400, as illustrated in FIG. 4, may include a data aligner 430 which realigns pieces of input video data Ri, Gi, and Bi transferred from an external system on the basis of a timing synchronization signal TSS transferred from the external system and supplies pieces of realigned image data Data to the data driver 301, a control signal generator 420 which generates a gate control signal GCS and a data control signal DCS by using the timing synchronization signal TSS, an input unit 410 which receives the timing synchronization signal TSS and the pieces of input video data Ri, Gi, and Bi transferred from the external system and transfers the received pieces of input video data Ri, Gi, and Bi and timing synchronization signal TSS to the data aligner 430 and the control signal generator 420, and an output unit 440 which outputs the gate control signal GCS and the data control signal DCS, generated by the control signal generator 420, to the data driver 301 or the gate driver 200.

That is, the controller 400 may generate pieces of image data corresponding to intensity of light which are to be output from the pixels and may transfer the generated image data to the data driver 301.

The controller 400 may transfer the pieces of image data to the data driving unit 300 by using an embedded clock point-point interface (EPI) method. As illustrated in FIG. 1, the controller 400 using the EPI method may transfer the pieces of image data Data to each of the two data drivers 301. However, the present disclosure is not limited to a display apparatus using the EPI method.

The control signal generator 420 may generate a first selection signal SEL1 for controlling a first selection unit included in the data driver 301 and a second selection signal SEL2 for controlling a second selection unit included in the data driver 301.

The data driver 301 may generate data voltages by using the pieces of image data and may output the data voltages to the data lines DL1 to DLd.

Hereinafter, a configuration and a function of the data driver 301 will be described below in detail with reference to FIGS. 5 to 13.

The gate driver 200 may be configured with an integrated circuit (IC) and may be mounted in the non-display area NAA, or may be directly embedded into the non-display area NAA by using a gate-in panel (GIP) type.

Figure 5:
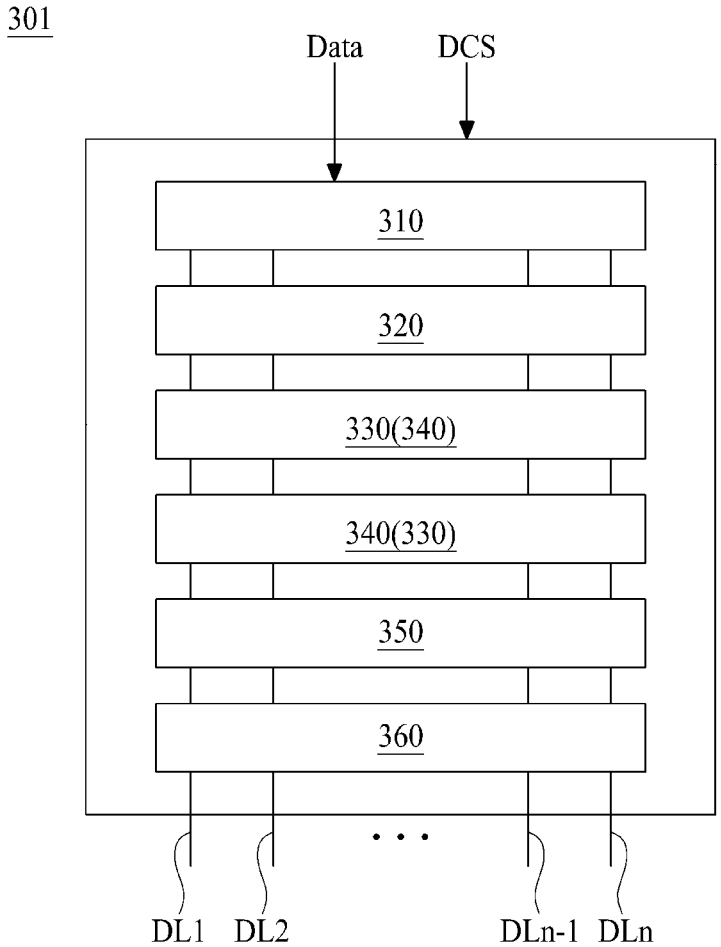
FIG. 5 is an exemplary diagram illustrating a configuration of a data driver applied to a display apparatus according to one embodiment of the present disclosure.

FIG. 5 is an exemplary diagram illustrating a configuration of a data driver applied to a display apparatus according to the present disclosure.

The data driving unit 300 applied to the display apparatus according to the present disclosure may include the at least one data driver 301 which supplies a data voltage to the data line.

The controller 400 may transfer the pieces of image data Data to the data driver 301.

When the data driving unit 300 includes at least two data drivers 301, the controller 400 may transfer the pieces of image data Data to the data drivers 301. In FIG. 1, the data driving unit 300 including the two data drivers 301 is illustrated as an example of the present disclosure.

In this case, configurations and functions of the data drivers 301 may be the same.

Hereinafter, therefore, the present disclosure will be described with reference to one of the two data drivers 301 illustrated in FIG. 1. Particularly, the present disclosure will be described below with reference to a data driver 301 connected to a first data line DL1 and an nth data line DLn among the two data drivers 301 illustrated in FIG. 1.

As illustrated in FIG. 2, the first-side pixels PX1 and the second-side pixels PX2 may be provided along the data line DL at both sides of the one data line DL connected to the data driver 301 and may be alternately connected to the data line DL.

The data driver 301 may output data voltages to pixels of the first horizontal line HL1 and pixels of the second horizontal line HL2 illustrated in FIG. 2.

In this case, the data driver 301 may generate data voltages which are to be output to the pixels of the second horizontal line HL2, based on pieces of image data Data corresponding to the first horizontal line HL1.

Therefore, when it is determined that the pieces of image data Data corresponding to the pixels of the first horizontal line HL1 are the same as pieces of image data Data corresponding to the pixels of the second horizontal line HL2, the controller 400 may transfer the pieces of image data Data, corresponding to the pixels of the first horizontal line HL1, to the data driver 301 and may not transfer the pieces of image data Data, corresponding to the pixels of the second horizontal line HL2, to the data driver 301.

In this case, the data driver 301 may generate data voltages which are to be output to the pixels of the second horizontal line HL2, based on the pieces of image data Data corresponding to the first horizontal line HL1.

Because the pieces of image data Data corresponding to the second horizontal line HL2 are not transferred from the controller 400 to the data driver 301, power consumption needed for transferring pieces of image data may be reduced.

To this end, as illustrated in FIG. 5, the data driver 301 may include a first latch 310 which receives pieces of image data Data from the controller 400, a second latch 330 which receives pieces of image data Data transferred from the first latch 310, a conversion unit 350 which converts the pieces of image data Data into data voltages, a buffer unit 360 which outputs the data voltages to the data lines DL1 to DLn included in the display panel, a first selection unit 320 which transfers the pieces of image data Data, stored in the first latch 310, to the second latch 330, and a second selection unit 340 which transfers the pieces of image data between the second latch 330 and the conversion unit 350 or between the first selection unit 320 and the second latch 330.

An embodiment, where the second selection unit 340 transfers the pieces of image data between the second latch 330 and the conversion unit 350, will be described below with reference to FIGS. 6 to 11.

An embodiment, where the second selection unit 340 transfers the pieces of image data between the first selection unit 320 and the second latch 330, will be described below with reference to FIGS. 12 and 13.

Figure 6:
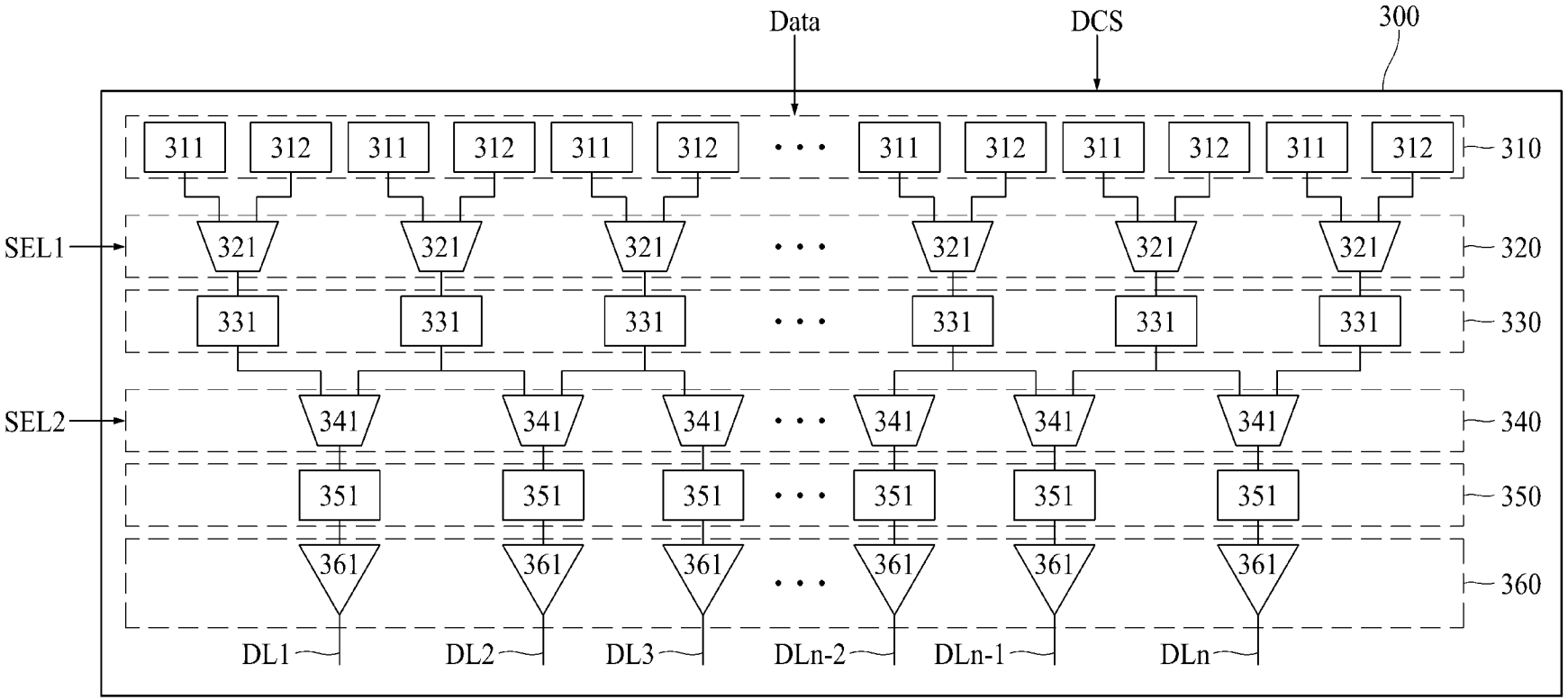
FIG. 6 is an exemplary diagram illustrating a configuration of a data driver applied to a display apparatus according to one embodiment of the present disclosure.
Figure 7:
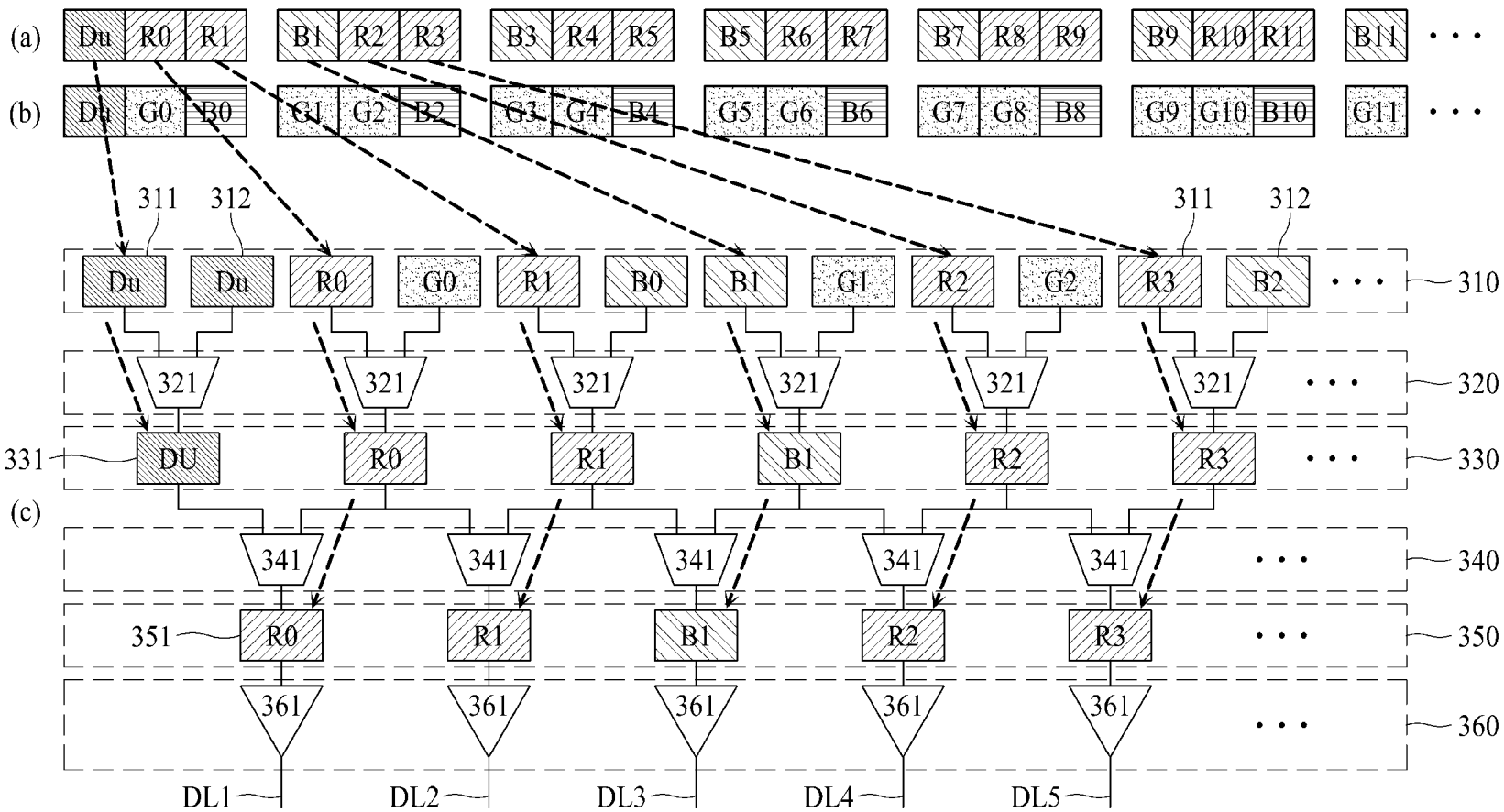
FIG. 7 is an exemplary diagram illustrating a method of processing pieces of image data by using the data driver illustrated in FIG. 6 according to one embodiment of the present disclosure.

FIG. 6 is an exemplary diagram illustrating a configuration of a data driver applied to a display apparatus according to the present disclosure, and FIG. 7 is an exemplary diagram illustrating a method of processing pieces of image data by using the data driver illustrated in FIG. 6. FIG. 7 part (a) represents pieces of first image data, FIG. 7 part (b) represents pieces of second image data, and FIG. 7 part (c) represents a driving method of the data driver 300.

Hereinafter, a display panel having a structure illustrated in FIG. 4 will be described for example. Particularly, in the following description, a pixel 110 is represented as data of a corresponding pixel like R0, G0, and B0. R0, G0, and B0 may represent image data.

For example, in a display panel 100 having a structure illustrated in FIG. 2, a first data line DL1 may be connected to RO and G0 of a first horizontal line HL1, a second data line DL2 may be connected to B0 and R1 of the first horizontal line HL1 and RO and G0 of a second horizontal line HL2, and a third data line DL3 may be connected to G1 and B1 of the first horizontal line HL1 and B0 and R1 of the second horizontal line HL2.

In this case, a first gate line GL1 may be connected to R0, R1, B1, R2, R3, and B3 of the first horizontal line HL1, a second gate line GL2 may be connected to G0, B0, G1, G2, B2, and G3 of the first horizontal line HL1, a third gate line GL3 may be connected to R0, R1, B1, R2, R3, and B3 of the second horizontal line HL2, and a fourth gate line GL4 may be connected to G0, B0, G1, G2, B2, and G3 of the second horizontal line HL2.

Therefore, while a gate pulse is being supplied to the first gate line GL1, data voltages corresponding to R0, R1, B1, R2, R3, and B3 of the first horizontal line HL1 are output through first to sixth data lines DL1 to DL6. To this end, the controller 400 may transfer pieces of image data (hereinafter simply referred to as first image data) corresponding to R0, R1, B1, R2, R3, and B3 of the first horizontal line HL1 to the data driver 301 at a first timing.

Moreover, while the gate pulse is being supplied to the second gate line GL2, data voltages corresponding to G0, B0, G1, G2, B2, and G3 of the first horizontal line HL1 are output through the first to sixth data lines DL1 to DL6. To this end, the controller 400 may transfer pieces of image data (hereinafter simply referred to as second image data) corresponding to G0, B0, G1, G2, B2, and G3 of the first horizontal line HL1 to the data driver 301 at a second timing.

Therefore, the pieces of first image data supplied to the data driver 301 at the first timing and the pieces of second image data supplied to the data driver 301 at the second timing are illustrated in FIGS. 7 part (a) and part (b). Pixels illustrated in FIG. 7 part (a) denote the pieces of first image data, and pixels illustrated in FIG. 7 part (b) denote the pieces of second image data. In addition to the pieces of first image data and the pieces of second image data illustrated in FIG. 7, pieces of image data corresponding to seventh to eighteenth data lines are further illustrated based on a structure illustrated in FIG. 2.

Moreover, in FIG. 7, Du denotes dummy image data.

That is, in order for all of the pixels of the first horizontal line HL1 to display an image, the pieces of first image data illustrated in FIG. 7 part (a) should be transferred from the controller 400 to the data driver 301 at the first timing, and the pieces of second image data illustrated in FIG. 7 part (b) should be transferred from the controller 400 to the data driver 301 at the second timing.

The data driver 301, as illustrated in FIGS. 6 and 7, may include a first latch unit 310 which receives the pieces of image data, a second latch unit 330 which stores pieces of image data transferred through the first latch unit 310, a first selection unit 320 which selects the pieces of image data stored in the first latch unit 310 on the basis of a first selection signal SEL1 and transfers the selected image data to the second latch unit 330, a conversion unit 350 including a plurality of converters 351 which convert the pieces of image data, transferred from the second latch unit 330, into data voltages, a second selection unit 340 which selects the pieces of image data stored in the second latch unit 330 on the basis of a second selection signal SEL2 and transfers the selected image data to the conversion unit 350, and a buffer unit 360 which outputs the data voltages to the data lines included in the display panel.

Particularly, in the data driver 301, the first latch unit 310 may include a 1-1th latch unit which stores the pieces of first image data received at the first timing among the pieces of image data and a 1-2th latch unit which stores the pieces of second image data received at the second timing among the pieces of image data. The 1-1th latch unit may include a plurality of 1-1th latches 311 which store the pieces of first image data, and the 1-2th latch unit may include a plurality of 1-2th latches 312 which store the pieces of second image data.

The first selection unit 320 may select the pieces of first image data stored in the 1-1th latches 311 configuring the 1-1th latch unit, or may select the pieces of second image data stored in the 1-2th latches 312 configuring the 1-2th latch unit. To this end, the first selection unit 320 may include a plurality of first selectors 321 for selecting one piece of image data from among pieces of image data adjacent to one another.

The second selection unit 340 may transfer the pieces of first image data, stored in the second latch unit 330, to converters 351 corresponding to data lines to which the pieces of first image data are to be output, or may transfer the pieces of second image data, stored in the second latch unit 330, to converters 351 corresponding to data lines to which the pieces of second image data are to be output. To this end, the second selection unit 340 may include a second selector 341 for selecting one piece of image data from among pieces of image data adjacent to one another.

The buffer unit 360 may include a plurality of buffers 361 connected to the data lines.

A detailed driving method of the data driver 301 will be described below.

First, in the data driver 301 illustrated in FIG. 6, the pieces of first image data may be transferred to the first latch unit 310, and particularly, may be stored in the 1-1th latch unit configuring the first latch unit. The pieces of second image data may be stored in the 1-2th latch unit configuring the first latch unit.

The 1-1th latch unit may include the 1-1th latches 311, and the 1-2th latch unit may include the 1-2th latches 312. The 1-1th latches 311 and the 1-2th latches 312 may be alternately arranged as illustrated in FIG. 6. The 1-1th latches 311 and the 1-2th latches 312 being alternately arranged as illustrated in FIG. 6 may denote that the first image data and the second image data are alternately stored in the 1-1th latches 311 and the 1-2th latches 312, and thus, the 1-1th latches 311 and the 1-2th latches 312 may not be physically and alternately arranged.

That is, the pieces of first image data may be respectively stored in the 1-1th latches 311 illustrated in FIG. 6, and the pieces of second image data may be respectively stored in the 1-2th latches 312.

For example, the pieces of first image data corresponding to Du, R0, R1, B1, R2, and R3 received at the first timing may be sequentially stored in the 1-1th latches 311 as illustrated in FIG. 7.

The pieces of second image data corresponding to Du, G0, B0, G1, G2, and B2 received at the second timing may be sequentially stored in the 1-2th latches 312 as illustrated in FIG. 7.

As described above, because the 1-1th latches 311 and the 1-2th latches 312 are alternately arranged, the pieces of first image data and the pieces of second image data may be alternately stored in the first latch unit 310. Accordingly, the first image data and the second image data may be stored to be adjacent to each other.

Subsequently, the first selection unit 320 may select the pieces of first image data stored in the 1-1th latches 311 and may transfer the selected pieces of first image data to the second latch unit 330, or may select the pieces of second image data stored in the 1-2th latches 312 and may transfer the selected pieces of second image data to the second latch unit 330.

Particularly, in FIG. 7, an example is illustrated where the pieces of first image data are selected by the first selection signal SEL1 and are stored in the second latch unit 330. That is, the pieces of first image data may be stored in the second latches 331 configuring the second latch unit 330.

Subsequently, the second selection unit 340 may transfer the pieces of first image data, stored in the second latch unit 330, to converters 351 corresponding to data lines to which the pieces of first image data are to be output, or may transfer the pieces of second image data, stored in the second latch unit 330, to converters 351 corresponding to data lines to which the pieces of second image data are to be output.

For example, as illustrated in FIG. 2, a data voltage corresponding to R0 may be supplied to a first data line DL1, a data voltage corresponding to R1 may be supplied to a second data line DL2, a data voltage corresponding to B1 may be supplied to a third data line DL3, a data voltage corresponding to R2 may be supplied to a fourth data line DL4, and a data voltage corresponding to R3 may be supplied to a fifth data line DL5.

Therefore, in FIG. 7, an example is illustrated where pieces of first image data corresponding to R0, R1, B1, R2, and R3 are transferred to converters 351 corresponding to first to fifth data lines DL1 to DL5.

Subsequently, data voltages generated by the converters 351 may be transferred to corresponding pixels through the first to fifth data lines DL1 to DL5.

Therefore, light corresponding to the pieces of first image data transferred to the data driver 301 at the first timing may be output through R0, R1, B1, R2, and R3 of the first horizontal line.

Subsequently, light corresponding to the pieces of first image data may be selected, and then, the first selection unit 320 may select the pieces of second image data stored in the 1-2th latches 312 and may transfer the selected second image data to the second latch unit 330.

Subsequently, the second selection unit 340 may transfer the pieces of second image data, stored in the second latch unit 330, to converters 351 corresponding to data lines to which the pieces of second image data are to be output.

Therefore, pieces of second image data corresponding to G0, B0, G1, G2, and B2 may be transferred to converters 351 corresponding to the first to fifth data lines DL1 to DL5.

Finally, data voltages generated by the converters 351 may be transferred to corresponding pixels through the first to fifth data lines DL1 to DL5.

Therefore, light corresponding to the pieces of second image data transferred to the data driver 301 at the second timing may be output through G0, B0, G1, G2, and B2 of the first horizontal line HL1.

Therefore, light may be output from all pixels of the first horizontal line HL1.

While the processes are being performed or before the processes are performed, the controller 400 may compare pieces of image data corresponding to the first horizontal line HL1 with pieces of image data corresponding to the second horizontal line HL2.

When the pieces of image data corresponding to the first horizontal line HL1 are not the same as the pieces of image data corresponding to the second horizontal line HL2 as a result of the comparison, the above-described processes may be identically performed on the pieces of image data corresponding to the second horizontal line HL2.

When the pieces of image data corresponding to the first horizontal line HL1 are the same as the pieces of image data corresponding to the second horizontal line HL2 as a result of the comparison, the controller 400 may not transfer the pieces of image data, corresponding to the second horizontal line HL2, to the data driver 301.

In this case, all of the pieces of image data corresponding to the first horizontal line HL1 may be stored in the first latch unit 310.

Therefore, when the above-described processes are again performed on the pieces of image data which are stored in the first latch unit 310 and correspond to the first horizontal line HL1, the same light as light output from pixels corresponding to the first horizontal line HL1 may be output from pixels corresponding to the second horizontal line HL2.

That is, according to the present disclosure, when the pieces of image data corresponding to the first horizontal line HL1 are the same as the pieces of image data corresponding to the second horizontal line HL2, although the pieces of image data corresponding to the second horizontal line HL2 are not transferred from the controller 400 to the data driver 301, the pixels corresponding to the second horizontal line HL2 may be driven based on the pieces of image data corresponding to the first horizontal line HL1.

Therefore, according to the present disclosure, power consumption may be reduced.

Figure 8:
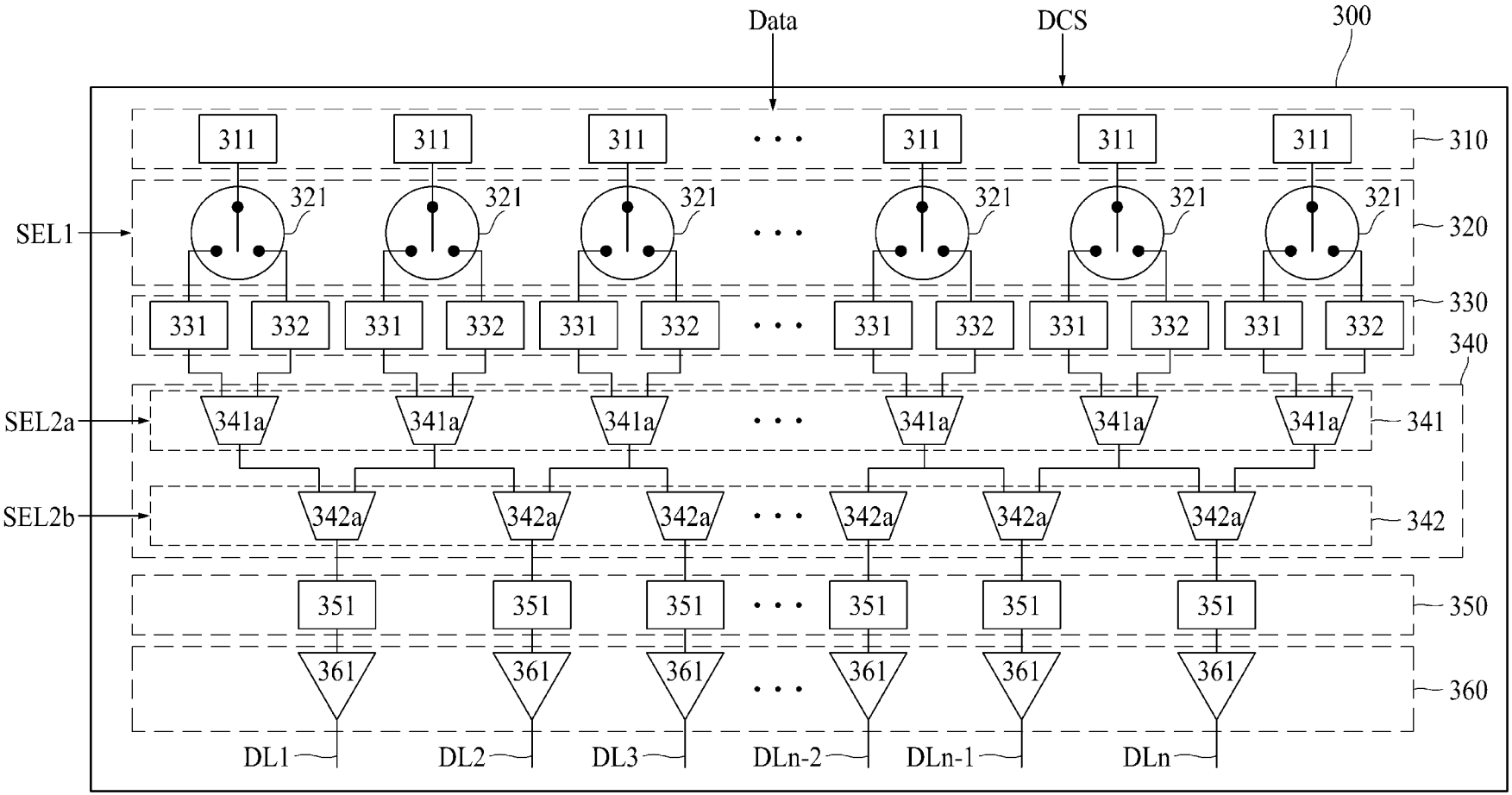
FIG. 8 is another exemplary diagram illustrating a configuration of a data driver applied to a display apparatus according to one embodiment of the present disclosure.
Figure 9:
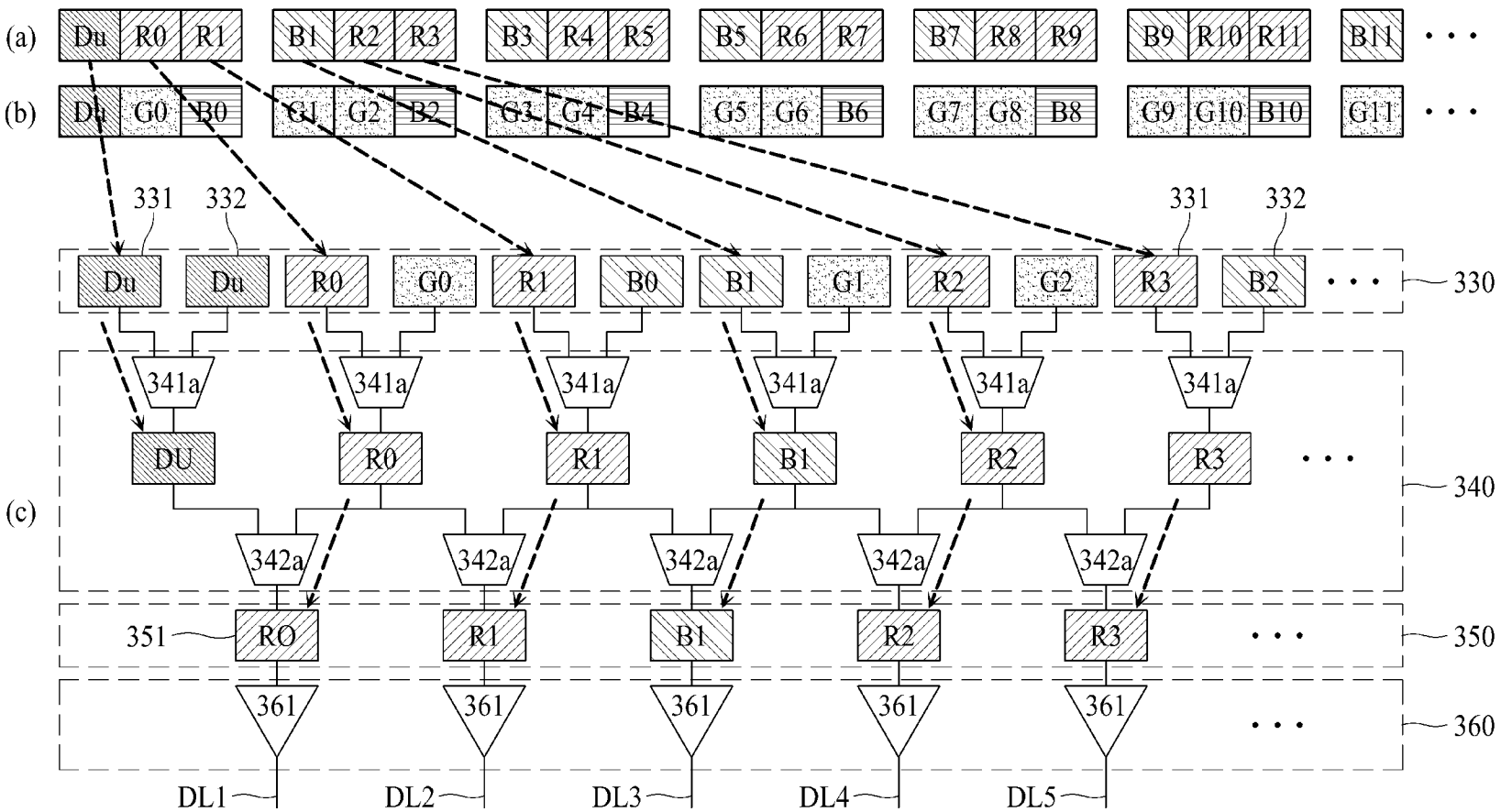
FIG. 9 is an exemplary diagram illustrating a method of processing pieces of image data by using the data driver illustrated in FIG. 8 according to one embodiment of the present disclosure.

FIG. 8 is another exemplary diagram illustrating a configuration of a data driver applied to a display apparatus according to the present disclosure, and FIG. 9 is an exemplary diagram illustrating a method of processing pieces of image data by using the data driver illustrated in FIG. 8. FIG. 9 part (a) represents pieces of first image data, FIG. 9 part (b) represents pieces of second image data, and FIG. 9 part (c) represents a driving method of a data driver 300. In the following description, descriptions which are the same as or similar to descriptions given above with reference to FIGS. 6 and 7 are omitted or will be briefly given.

The data driver 301, as illustrated in FIGS. 8 and 9, may include a first latch unit 310 which receives the pieces of image data, a second latch unit 330 which stores pieces of image data transferred through the first latch unit 310, a first selection unit 320 which selects the pieces of image data stored in the first latch unit 310 on the basis of a first selection signal SEL1 and transfers the selected image data to the second latch unit 330, a conversion unit 350 including a plurality of converters 351 which convert the pieces of image data, transferred from the second latch unit 330, into data voltages, a second selection unit 340 which selects the pieces of image data stored in the second latch unit 330 on the basis of a second selection signal SEL2 and transfers the selected image data to the conversion unit 350, and a buffer unit 360 which outputs the data voltages to the data lines included in the display panel.

In the data driver 301, the first latch unit 310 may include a plurality of first latches 311 which temporarily store the pieces of first image data and the pieces of second image data.

In the data driver 301, the second latch unit 330 may include a 2-1th latch unit which stores the pieces of first image data received at a first timing among the pieces of image data and a 2-2th latch unit which stores the pieces of second image data received at a second timing among the pieces of image data. The 2-1th latch unit may include a plurality of 2-1th latches 331, and the 2-2th latch unit may include a plurality of 2-2th latches 332.

The first selection unit 320 may transfer the pieces of first image data to the 2-1th latch unit and may transfer the pieces of second image data to the 2-2th latch unit. To this end, the first selection unit 320 may include a plurality of first selectors 321.

The second selection unit 340 may transfer the pieces of first image data, stored in the 2-1th latch unit, to converters 351 corresponding to data lines to which the pieces of first image data are to be output, or may transfer the pieces of second image data, stored in the 2-2th latch unit, to converters 351 corresponding to data lines to which the pieces of second image data are to be output.

To this end, the second selection unit 340 may include a 2-1th selection unit 341 which selects the pieces of first image data stored in the 2-1th latch unit or selects the pieces of second image data stored in the 2-2th latch unit and a 2-2th selection unit 342 which transfers the pieces of first image data, selected by the 2-1th selection unit 341, to converters 351 corresponding to data lines to which the pieces of first image data are to be output, or transfers the pieces of second image data, selected by the 2-1th selection unit 341, to converters 351 corresponding to data lines to which the pieces of second image data are to be output. The 2-1th selection unit 341 may include a plurality of 2-1th selectors 341*a*, and the 2-2th selection unit 342 may include a plurality of 2-2th selectors 342*a*.

A detailed driving method of the data driver 301 will be described below.

First, in the data driver 301 illustrated in FIG. 8, the pieces of first image data may be transferred to the first latch unit 310.

In this case, the pieces of first image data may be transferred to the second latch unit 330 through the first selectors 321 turned on by the first selection signal SEL1, and particularly, may be stored in the 2-1th latch unit configuring the second latch unit 330.

Subsequently, the pieces of second image data may be transferred to the first latch unit 310.

In this case, the pieces of second image data may be transferred to the second latch unit 330 through the first selectors 321 turned on by the first selection signal SEL1, and particularly, may be stored in the 2-2th latch unit configuring the second latch unit 330.

The 2-1th latch unit may include the 2-1th latches 331, and the 2-2th latch unit may include the 2-2th latches 332. The 2-1th latches 331 and the 2-2th latches 332 may be alternately arranged as illustrated in FIG. 8. The 2-1th latches 331 and the 2-2th latches 332 being alternately arranged as illustrated in FIG. 8 may denote that the first image data and the second image data are alternately stored in the 2-1th latches 331 and the 2-2th latches 332, and thus, the 2-1th latches 331 and the 2-2th latches 332 may not be physically and alternately arranged.

That is, the pieces of first image data may be respectively stored in the 2-1th latches 331 illustrated in FIG. 8, and the pieces of second image data may be respectively stored in the 2-2th latches 332.

For example, the pieces of first image data corresponding to Du, R0, R1, B1, R2, and R3 received at the first timing may be sequentially stored in the 2-1th latches 331 as illustrated in FIG. 9.

The pieces of second image data corresponding to Du, G0, B0, G1, G2, and B2 received at the second timing may be sequentially stored in the 2-2th latches 332 as illustrated in FIG. 9.

As described above, because the 2-1th latches 331 and the 2-2th latches 332 are alternately arranged, the pieces of first image data and the pieces of second image data may be alternately stored in the second latch unit 330. Accordingly, the first image data and the second image data may be stored to be adjacent to each other.

Subsequently, the 2-1th selection unit 341 configuring the second selection unit 340 may select the pieces of first image data stored in the 2-1th latch unit. That is, the 2-1th selectors 341*a* may be controlled by a 2-1th selection signal SEL2*a* to select the pieces of first image data stored in the 2-1th latches 331.

Subsequently, the 2-2th selection unit 342 configuring the second selection unit 340 may transfer the pieces of first image data, selected by the 2-1th selection unit 341, to converters 351 corresponding to data lines to which the pieces of first image data are to be output. That is, the 2-2th selectors 342*a* may be controlled by a 2-2th selection signal SEL2*b* to transfer the pieces of first image data to the converters 351 corresponding to the data lines to which the pieces of first image data are to be output.

Subsequently, data voltages generated by the converters 351 may be transferred to corresponding pixels through the first to fifth data lines DL1 to DL5.

Therefore, light corresponding to the pieces of first image data transferred to the data driver 301 at the first timing may be output through R0, R1, B1, R2, and R3 of the first horizontal line.

Subsequently, light corresponding to the pieces of first image data may be selected, and then, the 2-1th selection unit 341 may select the pieces of second image data stored in the 2-2th latches 332.

Subsequently, the 2-2th selection unit 342 may transfer the pieces of second image data, selected by the 2-1th selection unit 341, to converters 351 corresponding to data lines to which the pieces of second image data are to be output.

Subsequently, pieces of second image data corresponding to G0, B0, G1, G2, and B2 may be transferred to converters 351 corresponding to the first to fifth data lines DL1 to DL5.

Finally, data voltages generated by the converters 351 may be transferred to corresponding pixels through the first to fifth data lines DL1 to DL5.

Therefore, light corresponding to the pieces of second image data transferred to the data driver 301 at the second timing may be output through G0, B0, G1, G2, and B2 of the first horizontal line HL1.

Therefore, light may be output from all pixels of the first horizontal line HL1.

While the processes are being performed or before the processes are performed, the controller 400 may compare pieces of image data corresponding to the first horizontal line HL1 with pieces of image data corresponding to the second horizontal line HL2.

When the pieces of image data corresponding to the first horizontal line HL1 are not the same as the pieces of image data corresponding to the second horizontal line HL2 as a result of the comparison, the above-described processes may be identically performed on the pieces of image data corresponding to the second horizontal line HL2.

When the pieces of image data corresponding to the first horizontal line HL1 are the same as the pieces of image data corresponding to the second horizontal line HL2 as a result of the comparison, the controller 400 may not transfer the pieces of image data, corresponding to the second horizontal line HL2, to the data driver 301.

In this case, all of the pieces of image data corresponding to the first horizontal line HL1 may be stored in the second latch unit 330.

Therefore, when the above-described processes are again performed on the pieces of image data which are stored in the second latch unit 330 and correspond to the first horizontal line HL1, the same light as light output from pixels corresponding to the first horizontal line HL1 may be output from pixels corresponding to the second horizontal line HL2.

That is, according to the present disclosure, when the pieces of image data corresponding to the first horizontal line HL1 are the same as the pieces of image data corresponding to the second horizontal line HL2, although the pieces of image data corresponding to the second horizontal line HL2 are not transferred from the controller 400 to the data driver 301, the pixels corresponding to the second horizontal line HL2 may be driven based on the pieces of image data corresponding to the first horizontal line HL1.

Therefore, according to the present disclosure, power consumption may be reduced.

Figure 10:
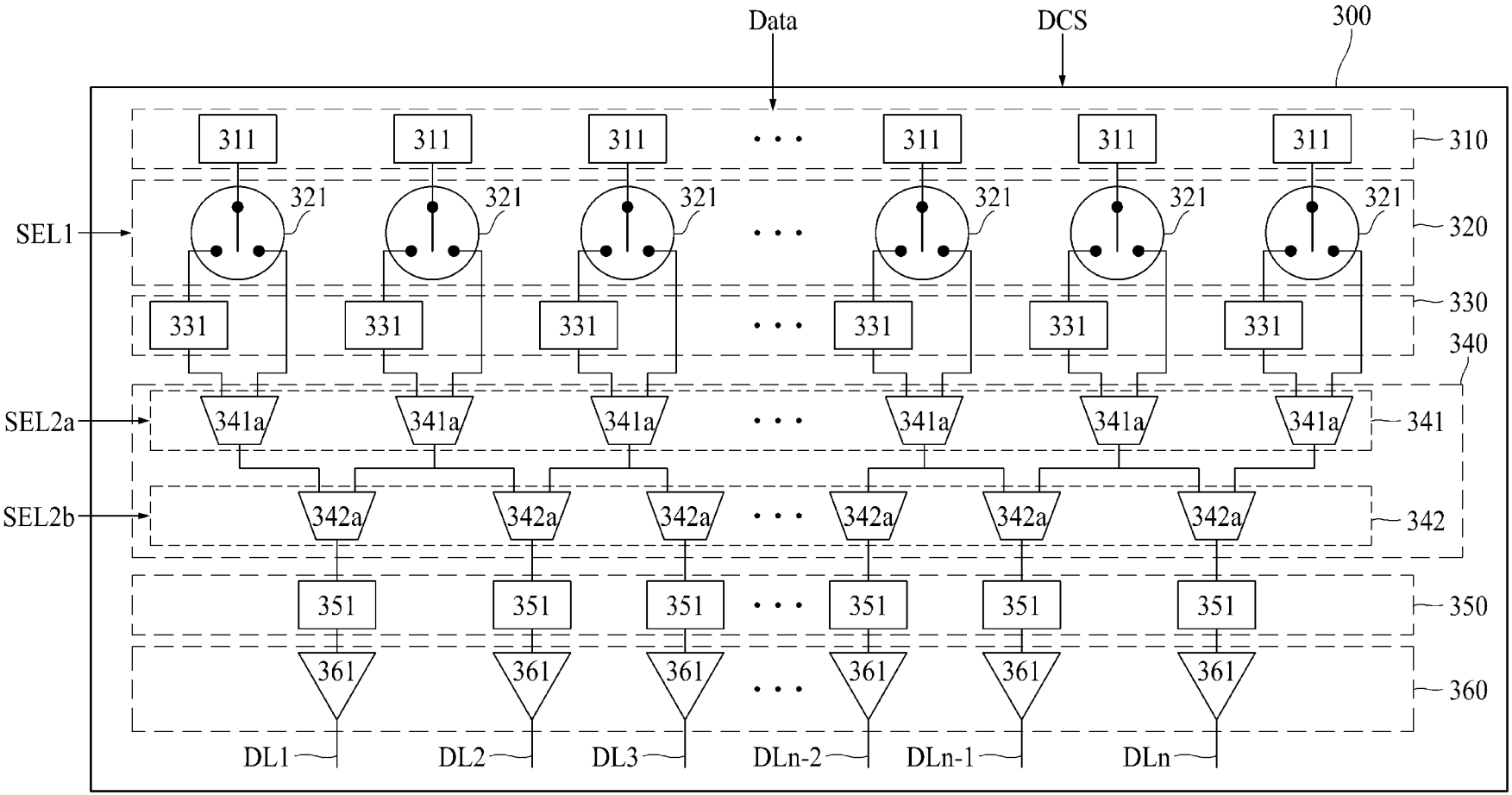
FIG. 10 is another exemplary diagram illustrating a configuration of a data driver applied to a display apparatus according to one embodiment of the present disclosure.
Figure 11:
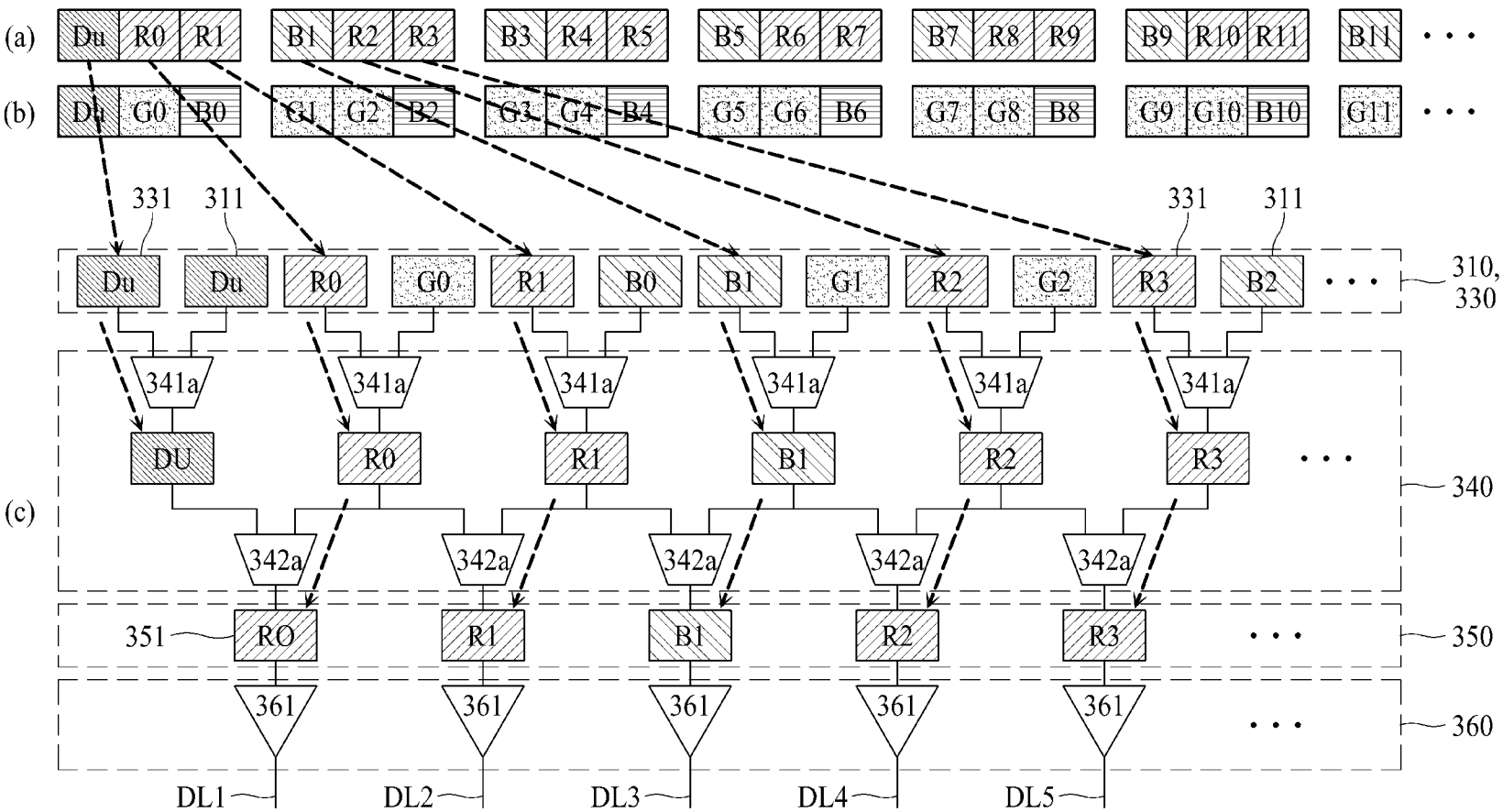
FIG. 11 is an exemplary diagram illustrating a method of processing pieces of image data by using the data driver illustrated in FIG. 10 according to one embodiment of the present disclosure.

FIG. 10 is another exemplary diagram illustrating a configuration of a data driver applied to a display apparatus according to the present disclosure, and FIG. 11 is an exemplary diagram illustrating a method of processing pieces of image data by using the data driver illustrated in FIG. 10. FIG. 11 part (a) represents pieces of first image data, FIG. 11 part (b) represents pieces of second image data, and FIG. 11 part (c) represents a driving method of a data driver 300. In the following description, descriptions which are the same as or similar to descriptions given above with reference to FIGS. 6 to 9 are omitted or will be briefly given.

The data driver 301, as illustrated in FIGS. 10 and 11, may include a first latch unit 310 which receives the pieces of image data, a second latch unit 330 which stores pieces of image data transferred through the first latch unit 310, a first selection unit 320 which selects the pieces of image data stored in the first latch unit 310 on the basis of a first selection signal SEL1 and transfers the selected image data to the second latch unit 330, a conversion unit 350 including a plurality of converters 351 which convert the pieces of image data, transferred from the second latch unit 330, into data voltages, a second selection unit 340 which selects the pieces of image data stored in the second latch unit 330 on the basis of a second selection signal SEL2 and transfers the selected image data to the conversion unit 350, and a buffer unit 360 which outputs the data voltages to the data lines included in the display panel.

In the data driver 301, the first latch unit 310 may store the pieces of second image data received at a second timing among the pieces of image data, and the second latch unit 330 may store the pieces of first image data received at a first timing among the pieces of image data. To this end, the first latch unit 310 may include a plurality of first latches 311, and the second latch unit 330 may include a plurality of second latches 331.

The first selection unit 320 may transfer the pieces of first image data, received at the first timing, to the second latch unit 330 and may transfer the pieces of second image data to the second selection unit 340. To this end, the first selection unit 320 may include a plurality of first selectors 321.

The second selection unit 340 may transfer the pieces of second image data, received through the first selection unit 310, to converters 351 corresponding to data lines to which the pieces of second image data are to be output, or may transfer the pieces of first image data, received from the second latch unit 330, to converters 351 corresponding to data lines to which the pieces of first image data are to be output.

The second selection unit 340 may include a 2-1th selection unit 341 which selects the pieces of second image data stored in the first latch unit 310 or selects the pieces of first image data stored in the second latch unit 330 and a 2-2th selection unit 342 which transfers the pieces of first image data, selected by the 2-1th selection unit 341, to converters 351 corresponding to data lines to which the pieces of first image data are to be output, or transfers the pieces of second image data, selected by the 2-1th selection unit 341, to converters 351 corresponding to data lines to which the pieces of second image data are to be output. The 2-1th selection unit 341 may include a plurality of 2-1th selectors 341*a*, and the 2-2th selection unit 342 may include a plurality of 2-2th selectors 342*a*.

A detailed driving method of the data driver 301 will be described below.

First, in the data driver 301 illustrated in FIG. 10, the pieces of first image data may be transferred to the first latch unit 310.

In this case, the pieces of first image data may be transferred to the second latch unit 330 through the first selectors 321 turned on by the first selection signal SEL1, and particularly, may be stored in the second latches 331 configuring the second latch unit 330.

Subsequently, the pieces of second image data may be transferred to the first latch unit 310.

In this case, the pieces of second image data may be stored in the first latches 311 configuring the first latch unit 310.

Subsequently, the 2-1th selection unit 341 configuring the second selection unit 340 may select the pieces of first image data stored in the second latch unit 330. That is, the 2-1th selectors 341*a* may be controlled by a 2-1th selection signal SEL2*a* to select the pieces of first image data stored in the second latches 331.

Subsequently, the 2-2th selection unit 342 configuring the second selection unit 340 may select the pieces of first image data, selected by the first selection unit 341, to converters 351 corresponding to data lines to which the pieces of first image data are to be output. That is, the 2-2th selectors 342*a* may be controlled by a 2-2th selection signal SEL2*b* to transfer the pieces of first image data to the converters 351 corresponding to the data lines to which the pieces of first image data are to be output.

Subsequently, data voltages generated by the converters 351 may be transferred to corresponding pixels through the first to fifth data lines DL1 to DL5.

Therefore, light corresponding to the pieces of first image data transferred to the data driver 301 at the first timing may be output through R0, R1, B1, R2, and R3 of the first horizontal line.

Subsequently, light corresponding to the pieces of first image data may be selected, and then, the 2-1th selection unit 341 may select the pieces of second image data stored in the first latches 311. In this case, the first selectors 321 may be turned on by the first selection signal SEL1 and may transfer the pieces of second image data, stored in the first latches 311, to the 2-1th selection unit.

Subsequently, the 2-2th selection unit 342 may transfer the pieces of second image data, selected by the 2-1th selection unit 341, to converters 351 corresponding to data lines to which the pieces of second image data are to be output.

Therefore, pieces of second image data corresponding to G0, B0, G1, G2, and B2 may be transferred to converters 351 corresponding to the first to fifth data lines DL1 to DL5.

Finally, data voltages generated by the converters 351 may be transferred to corresponding pixels through the first to fifth data lines DL1 to DL5.

Therefore, light corresponding to the pieces of second image data transferred to the data driver 301 at the second timing may be output through G0, B0, G1, G2, and B2 of the first horizontal line HL1.

Therefore, light may be output from all pixels of the first horizontal line HL1.

While the processes are being performed or before the processes are performed, the controller 400 may compare pieces of image data corresponding to the first horizontal line HL1 with pieces of image data corresponding to the second horizontal line HL2.

When the pieces of image data corresponding to the first horizontal line HL1 are not the same as the pieces of image data corresponding to the second horizontal line HL2 as a result of the comparison, the above-described processes may be identically performed on the pieces of image data corresponding to the second horizontal line HL2.

When the pieces of image data corresponding to the first horizontal line HL1 are the same as the pieces of image data corresponding to the second horizontal line HL2 as a result of the comparison, the controller 400 may not transfer the pieces of image data, corresponding to the second horizontal line HL2, to the data driver 301.

In this case, pieces of first image data among pieces of image data corresponding to the first horizontal line HL1 may be stored in the second latch unit 330, and pieces of second image data among the pieces of image data corresponding to the first horizontal line HL1 may be stored in the first latch unit 310. All of the pieces of image data corresponding to the first horizontal line HL1 may be stored in the first latch unit 310 and the second latch unit 330.

Therefore, when the above-described processes are again performed on the pieces of image data which are stored in the first latch unit 310 and the second latch unit 330 and correspond to the first horizontal line HL1, the same light as light output from pixels corresponding to the first horizontal line HL1 may be output from pixels corresponding to the second horizontal line HL2.

That is, according to the present disclosure, when the pieces of image data corresponding to the first horizontal line HL1 are the same as the pieces of image data corresponding to the second horizontal line HL2, although the pieces of image data corresponding to the second horizontal line HL2 are not transferred from the controller 400 to the data driver 301, the pixels corresponding to the second horizontal line HL2 may be driven based on the pieces of image data corresponding to the first horizontal line HL1.

Therefore, according to the present disclosure, power consumption may be reduced.

Figure 12:
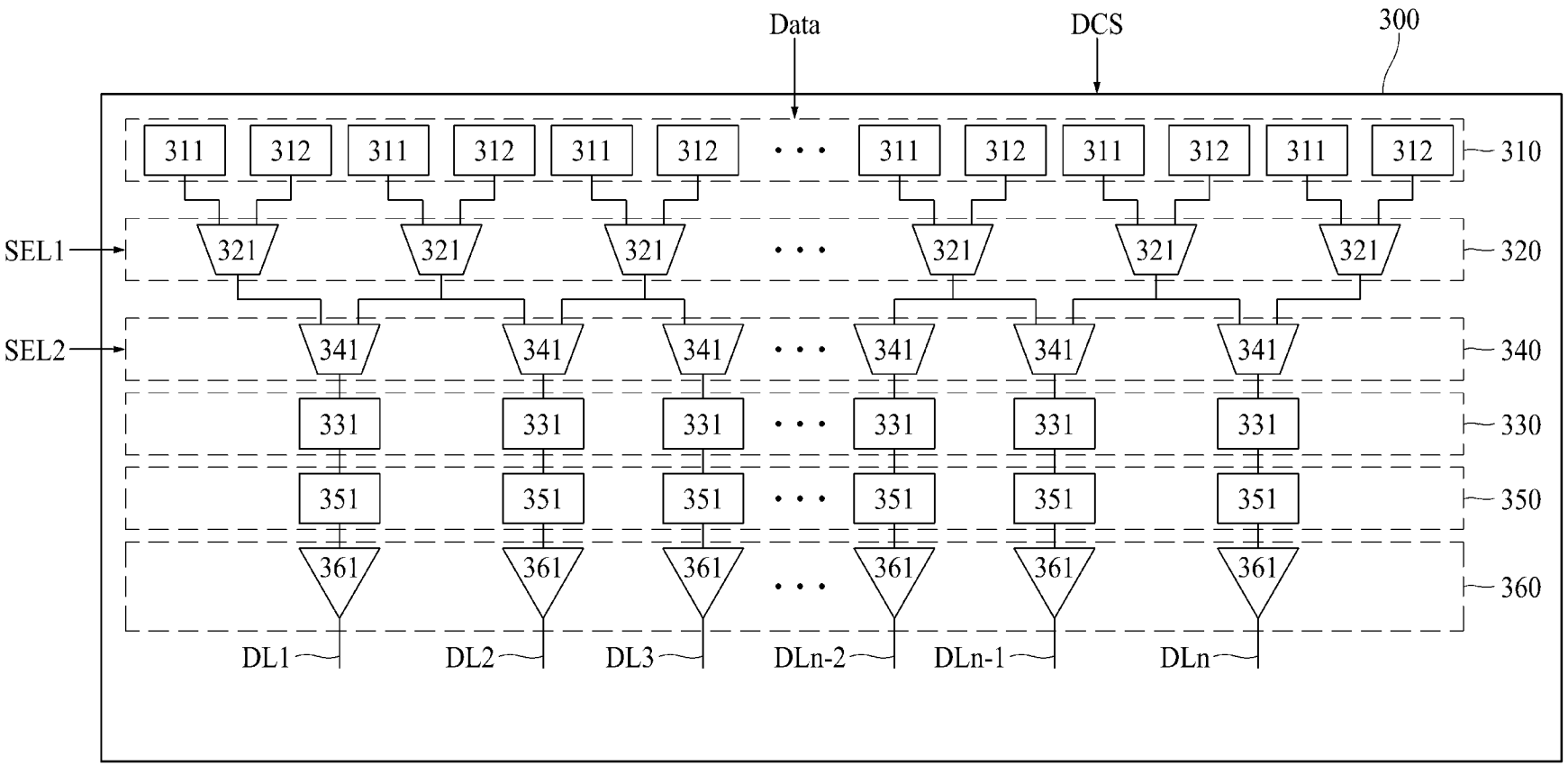
FIG. 12 is another exemplary diagram illustrating a configuration of a data driver applied to a display apparatus according to one embodiment of the present disclosure.
Figure 13:
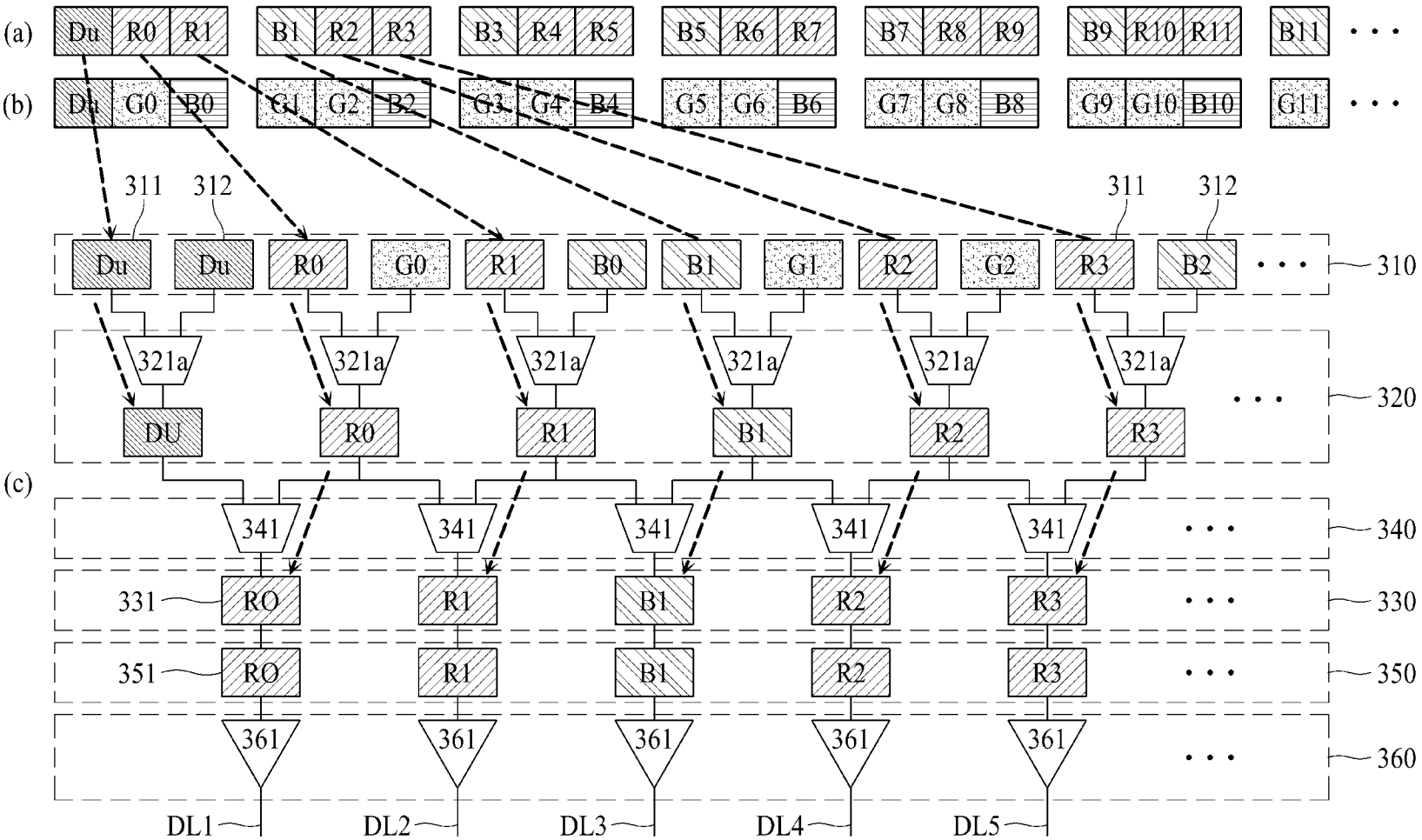
FIG. 13 is an exemplary diagram illustrating a method of processing pieces of image data by using the data driver illustrated in FIG. 12 according to one embodiment of the present disclosure.

FIG. 12 is another exemplary diagram illustrating a configuration of a data driver applied to a display apparatus according to the present disclosure, and FIG. 13 is an exemplary diagram illustrating a method of processing pieces of image data by using the data driver illustrated in FIG. 12. FIG. 13 part (a) represents pieces of first image data, FIG. 13 part (b) represents pieces of second image data, and FIG. 13 part (c) represents a driving method of a data driver 300. In the following description, descriptions which are the same as or similar to descriptions given above with reference to FIGS. 6 to 11 are omitted or will be briefly given.

The data driver 301, as illustrated in FIGS. 12 and 13, may include a first latch unit 310 which receives the pieces of image data, a second latch unit 330 which stores pieces of image data transferred through the first latch unit 310, a first selection unit 320 which selects the pieces of image data stored in the first latch unit 310 on the basis of a first selection signal SEL1, a second selection unit 340 which selects the pieces of image data selected by the first selection unit 320 on the basis of a second selection signal SEL2 and transfers the selected image data to the second latch unit 330, a conversion unit 350 which converts the pieces of image data, transferred from the second latch unit 330, into data voltages, and a buffer unit 360 which outputs the data voltages to the data lines included in the display panel.

In the data driver 301, the second latch unit 330 may include a plurality of second latches 331.

The first latch unit 310 may include a 1-1th latch unit which stores the pieces of first image data received at a first timing among the pieces of image data and a 1-2th latch unit which stores the pieces of second image data received at a second timing among the pieces of image data. The 1-1th latch unit may include a plurality of 1-1th latches 311, and the 1-2th latch unit may include a plurality of 1-2th latches 312.

The first selection unit 320 may select the pieces of first image data stored in the 1-1th latch unit and may transfer the selected first image data to the second selection unit 340, or may select the pieces of second image data stored in the 1-2th latch unit and may transfer the selected second image data to the second selection unit 340.

The second selection unit 340 may transfer the pieces of first image data, selected by the first selection unit 320, to the second latches 331 corresponding to data lines to which the pieces of first image data are to be output, or may transfer the pieces of second image data, selected by the first selection unit 320, to the second latches 331 corresponding to data lines to which the pieces of second image data are to be output.

A detailed driving method of the data driver 301 will be described below.

First, in the data driver 301 illustrated in FIG. 12, the pieces of first image data may be transferred to the first latch unit 310, and particularly, may be stored in the 1-1th latch unit configuring the first latch unit 310. The pieces of second image data may be stored in the 1-2th latch unit configuring the first latch unit 310.

The 1-1th latch unit may include the 1-1th latches 311, and the 1-2th latch unit may include the 1-2th latches 312. The 1-1th latches 311 and the 1-2th latches 312 may be alternately arranged as illustrated in FIG. 12. The 1-1th latches 311 and the 1-2th latches 312 being alternately arranged as illustrated in FIG. 12 may denote that the first image data and the second image data are alternately stored in the 1-1th latches 311 and the 1-2th latches 312, and thus, the 1-1th latches 311 and the 1-2th latches 312 may not be physically and alternately arranged.

That is, the pieces of first image data may be respectively stored in the 1-1th latches 311 illustrated in FIG. 12, and the pieces of second image data may be respectively stored in the 1-2th latches 312.

For example, the pieces of first image data corresponding to Du, R0, R1, B1, R2, and R3 received at the first timing may be sequentially stored in the 1-1th latches 311 as illustrated in FIG. 13.

The pieces of second image data corresponding to Du, G0, B0, G1, G2, and B2 received at the second timing may be sequentially stored in the 1-2th latches 312 as illustrated in FIG. 13.

As described above, because the 1-1th latches 311 and the 1-2th latches 312 are alternately arranged, the pieces of first image data and the pieces of second image data may be alternately stored in the first latch unit 310. Accordingly, the first image data and the second image data may be stored to be adjacent to each other.

Subsequently, the first selection unit 320 may select the pieces of first image data stored in the 1-1th latches 311 and may transfer the selected pieces of first image data to the second selection unit 340. That is, when the first selectors 321 are turned on by the first selection signal SEL1, the pieces of first image data stored in the 1-1th latches 311 may be transferred to the second selection unit 340 through the first selectors 321.

Subsequently, the second selection unit 340 may transfer the pieces of first image data, transferred from the first selectors 321, to the second latches 331 corresponding to data lines to which the pieces of first image data are to be output. That is, when the second selectors 341 are turned on by the second selection signal SEL2, the pieces of first image data may be transferred to the second latches 331 corresponding to data lines to which the pieces of first image data are to be output.

Subsequently, the pieces of first image data stored in the second latches 331 may be transferred to converters 351 corresponding to the second latches 331.

Subsequently, data voltages generated by the converters 351 may be transferred to corresponding pixels through the first to fifth data lines DL1 to DL5.

Therefore, light corresponding to the pieces of first image data transferred to the data driver 301 at the first timing may be output through R0, R1, B1, R2, and R3 of the first horizontal line.

Subsequently, light corresponding to the pieces of first image data may be selected, and then, the first selection unit 320 may select the pieces of second image data stored in the 1-2th latches 312 and may transfer the selected second image data to the second selection unit 340.

Subsequently, the second selection unit 340 may transfer the pieces of second image data, transferred from the first selection unit 320, to the second latches 331 corresponding to data lines to which the pieces of second image data are to be output.

Subsequently, the pieces of second image data stored in the second latches 331 may be transferred to converters 351 corresponding to the second latches 331.

Therefore, pieces of second image data corresponding to G0, B0, G1, G2, and B2 may be transferred to converters 351 corresponding to the first to fifth data lines DL1 to DL5.

Finally, data voltages generated by the converters 351 may be transferred to corresponding pixels through the first to fifth data lines DL1 to DL5.

Therefore, light corresponding to the pieces of second image data transferred to the data driver 301 at the second timing may be output through G0, B0, G1, G2, and B2 of the first horizontal line HL1.

Therefore, light may be output from all pixels of the first horizontal line HL1.

While the processes are being performed or before the processes are performed, the controller 400 may compare pieces of image data corresponding to the first horizontal line HL1 with pieces of image data corresponding to the second horizontal line HL2.

When the pieces of image data corresponding to the first horizontal line HL1 are not the same as the pieces of image data corresponding to the second horizontal line HL2 as a result of the comparison, the above-described processes may be identically performed on the pieces of image data corresponding to the second horizontal line HL2.

When the pieces of image data corresponding to the first horizontal line HL1 are the same as the pieces of image data corresponding to the second horizontal line HL2 as a result of the comparison, the controller 400 may not transfer the pieces of image data, corresponding to the second horizontal line HL2, to the data driver 301.

In this case, all of the pieces of image data corresponding to the first horizontal line HL1 may be stored in the first latch unit 310.

Therefore, when the above-described processes are again performed on the pieces of image data which are stored in the first latch unit 310 and correspond to the first horizontal line HL1, the same light as light output from pixels corresponding to the first horizontal line HL1 may be output from pixels corresponding to the second horizontal line HL2.

That is, according to the present disclosure, when the pieces of image data corresponding to the first horizontal line HL1 are the same as the pieces of image data corresponding to the second horizontal line HL2, although the pieces of image data corresponding to the second horizontal line HL2 are not transferred from the controller 400 to the data driver 301, the pixels corresponding to the second horizontal line HL2 may be driven based on the pieces of image data corresponding to the first horizontal line HL1.

Therefore, according to the present disclosure, power consumption may be reduced.

According to the present disclosure, when pieces of image data, corresponding to two horizontal lines to which data voltages are to be continuously output, are the same, data voltages corresponding to a first horizontal line of the two horizontal line and data voltages corresponding to a second horizontal line thereof may be generated.

Therefore, the pieces of image data corresponding to the second horizontal line may not be transferred from the controller to a data driver.

Accordingly, consumption power needed for transferring pieces of image data may be reduced.

The above-described feature, structure, and effect of the present disclosure are included in at least one embodiment of the present disclosure, but are not limited to only one embodiment. Furthermore, the feature, structure, and effect described in at least one embodiment of the present disclosure may be implemented through combination or modification of other embodiments by those skilled in the art. Therefore, content associated with the combination and modification should be construed as being within the scope of the present disclosure.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

What is claimed is:

1. A display apparatus comprising:

a display panel including two gate lines connected to pixels provided along one virtual horizontal line, and a plurality of first-side pixels and a plurality of second-side pixels provided along both sides of a data line are alternately connected to the data line;

a data driving unit including at least one data driver supplying a data voltage to the data line; and a controller transferring pieces of image data to the at least one data driver, wherein:

the at least one data driver converts the pieces of the image data into data voltages, the at least one data driver outputs the data voltages to pixels of a first virtual horizontal line and pixels of a second virtual horizontal line, and the at least one data driver generates the data voltages which are to be output to the pixels of the second virtual horizontal line, based on the pieces of image data corresponding to the data voltages output to the pixels of the first virtual horizontal line, wherein the data driver comprises:

a first latch unit receiving the pieces of image data;

a second latch unit storing the pieces of image data transferred through the first latch unit;

a first selection unit selecting the pieces of image data stored in the first latch unit based on a first selection signal and transferring the selected pieces of image data to the second latch unit;

a conversion unit including a plurality of converters converting the pieces of image data, transferred from the second latch unit, into data voltages;

a second selection unit selecting the pieces of image data stored in the second latch unit based on a second selection signal and transferring the selected pieces of image data to the conversion unit; and a buffer unit outputting the data voltages to a plurality of data lines included in the display panel, and wherein the data voltages which are to be output to the pixels of the second virtual horizontal line which are generated based on the pieces of image data corresponding to data voltages output to the pixels of the first virtual horizontal line, are generated by changing the second selection signal into a value different from that used during the generation of data voltages output to the pixels of the first virtual horizontal line.

2. The display apparatus of claim 1, wherein the first latch unit comprises a 1-1th latch unit storing pieces of first image data received at a first timing among the pieces of image data and a 1-2th latch unit storing pieces of second image data received at a second timing among the pieces of image data, the first selection unit selects the pieces of first image data stored in the 1-1th latch unit to transfer the selected pieces of first image data to the second latch unit, or selects the pieces of second image data stored in the 1-2th latch unit to transfer the selected pieces of second image data to the second latch unit, and the second selection unit transfers the pieces of first image data, stored in the second latch unit, to converters corresponding to data lines to which the pieces of first image data are to be output, or transfers the pieces of second image data, stored in the second latch unit, to converters corresponding to data lines to which the pieces of second image data are to be output.

3. The display apparatus of claim 1, wherein:

the second latch unit comprises a 2-1th latch unit storing pieces of first image data received at a first timing among the pieces of image data and a 2-2th latch unit storing pieces of second image data received at a second timing among the pieces of image data, the first selection unit transfers the pieces of first image data to the 2-1th latch unit, or transfers the pieces of second image data to the 2-2th latch unit, and the second selection unit transfers the pieces of first image data, stored in the 2-1th latch unit, to converters corresponding to data lines to which the pieces of first image data are to be output, or transfers the pieces of second image data, stored in the 2-2th latch unit, to converters corresponding to data lines to which the pieces of second image data are to be output.

4. The display apparatus of claim 3, wherein the second selection unit comprises:

a 2-1th selection unit selecting the pieces of first image data stored in the 2-1th latch unit or selecting the pieces of second image data stored in the 2-2th latch unit; and a 2-2th selection unit transferring the pieces of first image data, selected by the 2-1th selection unit, to converters corresponding to data lines to which the pieces of first image data are to be output, or transfers the pieces of second image data, selected by the 2-1th selection unit, to converters corresponding to data lines to which the pieces of second image data are to be output.

5. The display apparatus of claim 1, wherein:

the first latch unit stores pieces of second image data received at a second timing among the pieces of image data, the second latch unit stores pieces of first image data received at a first timing among the pieces of image data, the first selection unit transfers the pieces of first image data, received at the first timing, to the second latch unit, or transfers the pieces of second image data to the second selection unit, and the second selection unit transfers the pieces of second image data, received through the first selection unit, to converters corresponding to data lines to which the pieces of second image data are to be output, or transfers the pieces of first image data, received from the second latch unit, to converters corresponding to data lines to which the pieces of first image data are to be output.

6. The display apparatus of claim 5, wherein the second selection unit comprises:

a 2-1th selection unit selecting the pieces of first image data stored in the second latch unit or selecting the pieces of second image data stored in the first latch unit; and a 2-2th selection unit transferring the pieces of first image data, selected by the 2-1th selection unit, to converters corresponding to data lines to which the pieces of first image data are to be output, or transfers the pieces of second image data, selected by the 2-1th selection unit, to converters corresponding to data lines to which the pieces of second image data are to be output.

7. The display apparatus of claim 1, wherein both the first selection signal and the second selection signal are transferred from the controller to the at least one data driver.

8. The display apparatus of claim 1, wherein the controller does not transfer pieces of image data corresponding to the pixels of the second virtual horizontal line to the at least one data driver in case that the pieces of image data corresponding to the pixels of the second virtual horizontal line are determined to be same as pieces of image data corresponding to the pixels of the first virtual horizontal line.

9. The display apparatus of claim 1, wherein the controller comprises:

a data aligner realigning pieces of input video data transferred from an external system on the basis of a timing synchronization signal transferred from the external system and supplying pieces of realigned image data to the at least one data driver;

a control signal generator generating a data control signal for controlling the data driving unit by using the timing synchronization signal;

an input unit receiving the timing synchronization signal and the pieces of input video data transferred from the external system and transferring the received pieces of input video data and timing synchronization signal to the data aligner and the control signal generator; and an output unit outputting the data control signal and the pieces of realigned image data to the at least one data driver.

10. The display apparatus of claim 1, wherein the display panel includes any one of a light emitting display panel and a liquid crystal display panel.

11. The display apparatus of claim 1, wherein the plurality of first-side pixels and the plurality of second-side pixels are alternately connected to the data line in a direction of the data line.

12. A display apparatus comprising:

a display panel including two gate lines connected to pixels provided along one virtual horizontal line, and a plurality of first-side pixels and a plurality of second-side pixels provided along both sides of a data line are alternately connected to the data line;

a data driving unit including at least one data driver supplying a data voltage to the data line; and a controller transferring pieces of image data to the at least one data driver, wherein:

the at least one data driver converts the pieces of the image data into data voltages, the at least one data driver outputs the data voltages to pixels of a first virtual horizontal line and pixels of a second virtual horizontal line, and the at least one data driver generates the data voltages which are to be output to the pixels of the second virtual horizontal line, based on the pieces of image data corresponding to the data voltages output to the pixels of the first virtual horizontal line, wherein the data driver comprises:

a first latch unit receiving the pieces of image data;

a second latch unit storing the pieces of image data transferred through the first latch unit;

a first selection unit selecting the pieces of image data stored in the first latch unit based on a first selection signal;

a second selection unit selecting pieces of image data selected by the first selection unit based on a second selection signal and transferring the selected pieces of image data to the second latch unit;

a conversion unit converting the pieces of image data, transferred from the second latch unit, into data voltages; and a buffer unit outputting the data voltages to a plurality of data lines included in the display panel.

13. The display apparatus of claim 12, wherein:

the second latch unit comprises a plurality of second latches, the first latch unit comprises a 1-1th latch unit storing pieces of first image data received at a first timing among the pieces of image data and a 1-2th latch unit storing pieces of second image data received at a second timing among the pieces of image data, the first selection unit selects the pieces of first image data stored in the 1-1th latch unit to transfer the selected pieces of first image data to the second selection unit, or selects the pieces of second image data stored in the 1-2th latch unit to transfer the selected pieces of second image data to the second selection unit, and the second selection unit transfers the pieces of first image data, selected by the first selection unit, to some of the plurality of second latches corresponding to data lines to which the pieces of first image data are to be output, or transfers the pieces of second image data, selected by the first selection unit, to other second latches corresponding to data lines to which the pieces of second image data are to be output.

14. The display apparatus of claim 13, wherein the first and second virtual horizontal lines are two continuous horizontal lines, wherein each of the first set of second latches and the second set of second latches includes two or more second latches, and wherein only one second latch within the first set of second latches is not included in the second set of second latches, and only one second latch within the second set of second latches is not included in the first set of second latches.

15. A display apparatus comprising:

a display panel in which two gate lines are connected to pixels provided along one virtual horizontal line and a plurality of first-side pixels and a plurality of second-side pixels provided along both sides of a data line are alternately connected to the data line;

a data driving unit including at least one data driver supplying a data voltage to the data line;

a controller transferring pieces of image data to the at least one data driver, wherein the at least one data driver converts the pieces of image data into data voltages and outputs the data voltages to pixels of a first virtual horizontal line and pixels of a second virtual horizontal line, and wherein the controller does not transfer pieces of image data corresponding to the pixels of the second virtual horizontal line to the at least one data driver in case that the pieces of image data corresponding to the pixels of the second virtual horizontal line are determined to be same as pieces of image data corresponding to the pixels of the first virtual horizontal line, wherein the at least one data driver comprises:

a first latch unit receiving the pieces of the image data;

a second latch unit storing the pieces of the image data transferred through the first latch unit;

a first selection unit selecting the pieces of the image data stored in the first latch unit based on a first selection signal and transferring the selected pieces of the image data to the second latch unit;

a conversion unit including a plurality of converters converting the pieces of the image data, transferred from the second latch unit, into data voltages;

a second selection unit selecting the pieces of the image data stored in the second latch unit based on a second selection signal and transferring the selected pieces of the image data to the conversion unit; and a buffer unit outputting the data voltages to a plurality of data lines included in the display panel, and wherein the data voltages which are to be output to the pixels of the second virtual horizontal line which are generated based on the pieces of the image data corresponding to data voltages output to the pixels of the first virtual horizontal line, are generated by changing the second selection signal into a value different from that used during the generation of data voltages output to the pixels of the first virtual horizontal line.

16. The display apparatus of claim 15, wherein the at least one data driver generates data voltages which are to be output to the pixels of the second virtual horizontal line, based on pieces of image data corresponding to data voltages output to the pixels of the first virtual horizontal line.

* * * * *